United States Patent [19]

Benoit

[11] 4,303,135

[45] Dec. 1, 1981

[54] DIRECTIONAL DRILLING SUB

[76] Inventor: Lloyd F. Benoit, Rte. 1, Box 57B, Arnaudville, La. 70512

[21] Appl. No.: 40,966

[22] Filed: May 21, 1979

Related U.S. Application Data

[63] Continuation-in-part of Ser. No. 825,589, Aug. 18, 1977, Pat. No. 4,220,214.

[51] Int. Cl.[3] ..... E21B 7/08

[52] U.S. Cl. ..... 175/73; 175/256

[58] Field of Search ..... 175/61, 73, 74, 75, 175/256, 40, 45, 50, 78; 285/184, 282

[56] References Cited

U.S. PATENT DOCUMENTS

| | | | |
|---|---|---|---|
| 2,167,194 | 7/1939 | Anderson | 175/73 |
| 2,336,333 | 12/1943 | Zublin | 175/75 X |
| 2,345,766 | 4/1944 | Miller | 175/256 |
| 2,680,005 | 6/1954 | Storm | 175/256 |
| 3,190,374 | 6/1965 | Caperan et al. | 175/74 |
| 3,586,116 | 6/1971 | Tiraspolsky | 175/74 |
| 3,667,556 | 6/1972 | Henderson | 175/73 |
| 3,713,500 | 1/1973 | Russell | 175/94 |
| 3,717,208 | 2/1973 | Anderson | 175/74 |
| 4,067,404 | 1/1978 | Crase | 175/75 |
| 4,077,657 | 3/1978 | Trzeciak | 175/74 X |

FOREIGN PATENT DOCUMENTS

| | | | |
|---|---|---|---|
| 1494273 | 12/1977 | United Kingdom | 175/61 |

*Primary Examiner*—James A. Leppink
*Attorney, Agent, or Firm*—Keaty & Garvey

[57] ABSTRACT

A variable angle directional drilling "sub" provides a shifting end portion which allows the sub to be rotated from a first, in-line, axially straight orientation with the drill string to a selected second, angled or "bent" position, which second position is normally assoicated with conventional bent "subs" which are permanently structured in the bent position. The tool provides a multiple choice of varying angles to the sub in its bent position to satisfy differing directional drilling situations. A first embodiment (FIGS. 1–7) is manually set and varied at the surface by positioning two angularly marked sections temporarily rotatable with respect to each other until the desired angle set is matched up, while a second embodiment (FIGS. 8–9) is motor driven to allow varying the angle direction while "down in the hole". The device rotatably shifts about an off-set axis of rotation from the first (in-line) position to the second (bent) position either (in the first manually adjustable embodiment) upon the application of torsional force thereto, which torsional force can be applied, for example, by the actuation of a "turbodrill" (normally attached in operation), or (in the second motorized embodiment) by an electrical signal from the surface to a built-in motor contained within the tool. The axially aligned first position allows easy entry of the drill string, sub, and turbodrill into the well hole, while the second bent position is used down in the hole to commence directional dirlling at the desired off-set or deviated angle. In the first embodiment, the sub will return gradually to its original axially aligned position when the device is withdrawn from the wellhole, as such position is the path of minimum resistance for the withdrawing drill string and torsion is not present to hold the sub in the bent position; while in the second embodiment the built-in motor is merely backed off to its original position.

11 Claims, 11 Drawing Figures

DIRECTIONAL DRILLING SUB

REFERENCE TO RELATED APPLICATIONS

This application is a continuation-in-part of prior, co-pending application Ser. No. 825,589, filed Aug. 18, 1977, entitled "Directional Drilling Sub", now U.S. Pat. No 4,220,214 issued Sept. 2, 1980, the complete disclosure of which is incorporated herein by reference.

BACKGROUND OF THE INVENTION

1. Field of the Invention

The present invention relates to oil well drilling and more particularly relates to directional drilling. Even more particularly the present invention relates to the use of a "sub" in combination with, for example, a conventional turbodrill wherein in the invention the "sub" movably shifts from a first position in which the turbodrill is substantially axially aligned with the drill string, to a second or "bent" position whereby a deflection is created between the drill string and the turbodrill of a desired degree.

2. General Background and Prior Art

Although wellbores are normally planned to be drilled vertically, many occasions arise when it is necessary or advantageous to drill at an angle from the vertical. Controlled directional drilling, as it is referred to in the art, makes it possible to reach sub-surface points laterally remote from the point where the drill bit enters the earth. Some examples of the use of directional drilling are inaccessible locations (such as under rivers or like bodies of water when the drilling begins on land), salt dome control, relief well control, edgwell control, fault plane control and property line control. Additionally, directional drilling is employed in offshore applications where all the drilling necessarily must take place from a fixed platform in a location in the offshore waters. A further application of direction drilling is seen when obstructions prevent a substantially vertical well direction.

One method of directionally drilling wells is a whipstock method. Another method is a very popular method which employs the use of a turbodrill in combination with a bent sub assembly. The turbodrill is a conventional device which uses fluid that is pumped under pressure through the center of the motor directed downwardly through void areas between a "rotor" and the rubber-lined spiral passageway of an outer "stator". In order for the flow to occur, the rotor is displaced and turned within the stator by the pressure of the fluid column, thus powering the connecting rod, a hollow drive shaft and finally a conventional bit sub at the end of the tool.

One such manufactured turbodrill is the "Dyna-Drill" which was introduced in or about 1964. Operation and use of the "Dyna-Drill" for directional drilling can be found in "Dyna-Drill Handbook" (second edition) distributed by Dyna-Drill, Division of Smith International, Inc., P.O. Box 327, Long Beach, Calif. 90801. In drilling, a "sub" is a short threaded piece of drill pipe used to generally adapt together parts of the drilling string which could not otherwise be screwed together because of difference in thread size or design. In the case of directional drilling, the "sub" is bent to produce the desired angle between the lower portion of the drill string (a non-magnetic survey collar normally being the lowermost portion of the drill string which attaches to the sub) and the turbodrill, "Dyna-Drill", or the like which attaches to the opposite end of the sub (this general arrangement is illustrated in FIG. 1 of applicant's parent application Ser. No. 825,589 now U.S. Pat. No. 4,220,214, issued Sept. 2, 1980, wherein a conventional permanently bent sub of the prior art is illustrated).

The use of a fixed or non-shifting bent sub requires that the drill string must be lowered into the well from the surface with the bent sub creating a kink in the lowermost portion of the drill string, which kink causes problems in lowering the turbodrill into the well. Since the turbodrill is of some length (a length of thirty feet being exemplary), even a small degree of bending in the sub can create a relatively large eccentricity in the drill string.

Many patents have been issued which are directed to the problem of directional drilling. Most of these patents provide structures which are directed to solving the problem of effecting the direction of drilling itself, but do not completely and satisfactorily solve the problem of lowering the turbodrill and bent sub in the "kinked" position into the well or lowering it in an "unkinked" position and then allowing for later deviation when "down in the hole".

A listing of some prior patents which may be pertinent are listed in the following table.

| Prior Patents | | |
|---|---|---|
| U.S. Pat. No. | Inventor(s) | Issue Date |
| 2,018,007 | W. G. Brewster | 10/22/35 |
| 2,142,858 | T. E. McMahan | 1/3/39 |
| 2,197,019 | D. B. Monroe | 4/16/40 |
| 2,680,005 | L. W. Storm | 6/1/54 |
| 3,586,116 | W. Tiraspolsky etal | 6/22/71 |
| 3,679,236 | J. Warshawsky | 7/25/72 |
| 3,961,674 | J. T. Craig, Jr. etal | 6/8/76 |
| 4,015,673 | J. T. Craig, etal | 4/5/77 |
| 3,667,556 | Henderson | 6/1972 |
| 2,336,333 | Zublin | 12/1943 |
| 3,190,374 | Caperan et al | 6/1965 |
| 3,713,500 | Russell | 1/1973 |
| 4,067,404 | Crase | 1/1978 |

GENERAL DISCUSSION OF THE PRESENT INVENTION

The present invention in its preferred embodiments provides a variable directional angle drilling sub which shifts upon actuation of the attached turbodrill (1st embodiment) or a surface generated electrical signal (2nd embodiment) effecting a change in orientation of the sub from a first position in which the drill string and the turbodrill are axially aligned (see FIGS. 1 and 8) to a second position in which the drill string and turbodrill are deflected with respect to one another (see FIGS. 2 and 9), forming the selected one of a possible number of desired angles for directional drilling.

The apparatus of the present invention in its first embodiment is comprised generally of a barrel having an attachment at one end portion thereof, which attachment provides for example a threaded connection which can attach to a conventional drill string, or to a non-magnetic survey or "Monel" collar or the like. The inner portion of the barrel is provided with a sliding sleeve, the sleeve having connected to its outermost end portion a threaded or like connection member for attachment to the turbodrill. This connection member (to which a turbodrill is attachable) and the sleeve to which it is attached are movable with respect to the barrel both slidably and rotatably within certain limits. This movable connection member thus can be extended and retracted with respect to the barrel or rotated with respect thereto.

The movable connection member nearest the turbodrill is in the first embodiment also provided with locking lugs which cooperate with corresponding recesses on the barrel. When the movable connection member slides with the attached sleeve to an extended position (see FIGS. 1 and 4) rotation is free through the desired arcuate path effecting the "shift" from a first "aligned" position to a second, selected "bent" position. In such an extended posture, the lugs clear the corresponding recesses of the barrel. Likewise when the sliding sleeve allows the movable connection member to retract into the barrel, the lugs form a fixed non-rotating locking connection with the barrel (see FIGS. 2 and 3).

Rotation of the movable connection member (to which the turbodrill is connected) effects a change in axial orientation of the rotating connector and its attached turbodrill with respect to the drill string. Thus, a rotation through an arcuate path shifts the turbodrill from an axially aligned position with the drill string to a non-axially or deflected position with the drill string, which second or "bent" position is desirable for controlled, directional drilling.

The embodiments of the present invention allow selected variation of the angle of deviation within the tool itself so that the same tool can be used for a number of different angles. A first embodiment (FIGS. 1–7) has its particular selected angle of deviation manually set at the surface, while the second embodiment (FIGS. 8–9) has a built-in motor which allows variation of the angle of deviation with the tool in place down "in the hole".

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein:

FIG. 7 is a close-up, partial view, taken in cross-section along section lines 7—7 of FIG. 3; of the first embodiment, showing the structural details of the pin locking mechanism; while FIGS. 8 and 9 are side, cross-sectional views of a second preferred embodiment of the apparatus of the present invention, showing it in its aligned disposition (FIG. 8) and then in its "bent" disposition (FIG. 9); while

DETAILED DESCRIPTION OF THE PREFERRED EMBODIMENTS

Structure of First Embodiment

Figure 1:
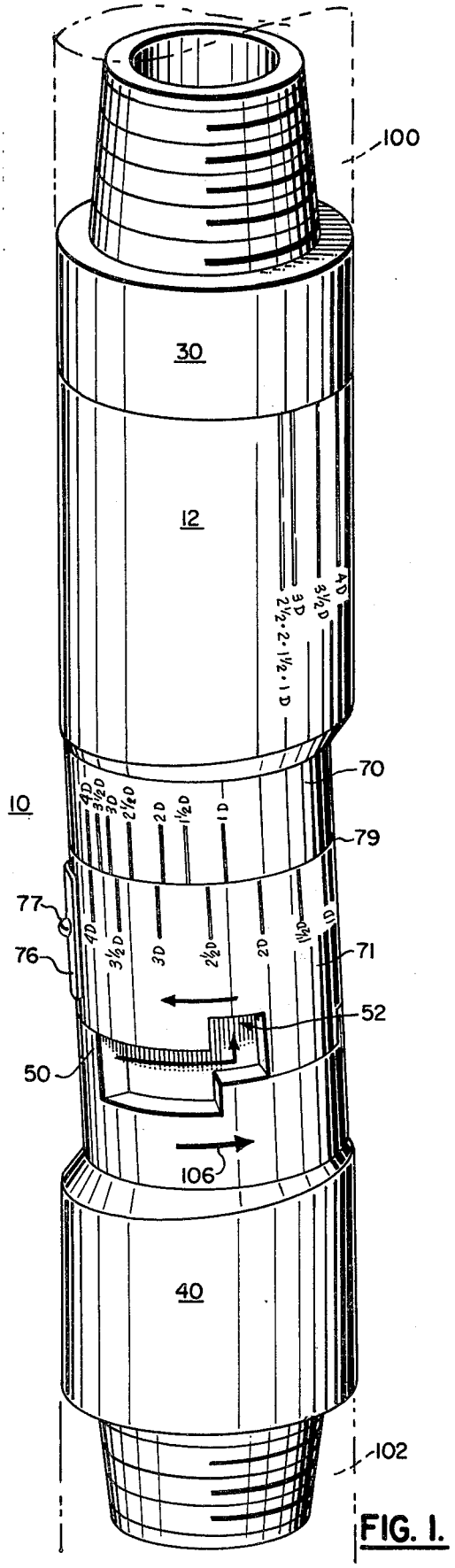
FIG. 1 is a side view of a first preferred embodiment of the apparatus of the present invention in its axially aligned position for lowering into the hole.

A first preferred embodiment of the tool of the present invention is designated generally by the numeral 10 in FIGS. 1–4. The tool 10 is comprised generally of an outer barrel 12 having an uppermost fixed end connection 30 and a lowermost movable connection 40. As can best be seen by an examination of FIGS. 1–4, rotation of movable connection 40 shifts connection 40 from a first axially aligned position (see FIGS. 1 and 4) to a second, selected, non-axial or "bent" position (see FIGS. 2 and 3).

FIG. 1 of applicant's parent application (Ser. No. 825,589 now U.S. Pat. No. 4,220,214, the complete disclosure of which is incorporated herein by reference) illustrates the operation of a conventional sub which is normally permanently fixed in the "bent" or non-axially aligned position shown. Such a conventional sub is usually manufactured by offsetting the bottom connection to form the desired angular configuration. In the approach of the preferred embodiments of the present invention, the sub 10 of the present invention would replace the conventional "bent" sub of FIG. 1 of the parent patent. Thus, the shifting sub 10 of the present invention could be attached for directional drilling purposes to the lower end of a drill string which is normally a non-metallic survey collar 100, with a turbodrill 102 being attached to the lower part of sub 10. This general drilling arrangement is seen with the prior art sub in FIG. 1 of the parent patent.

Figure 2:
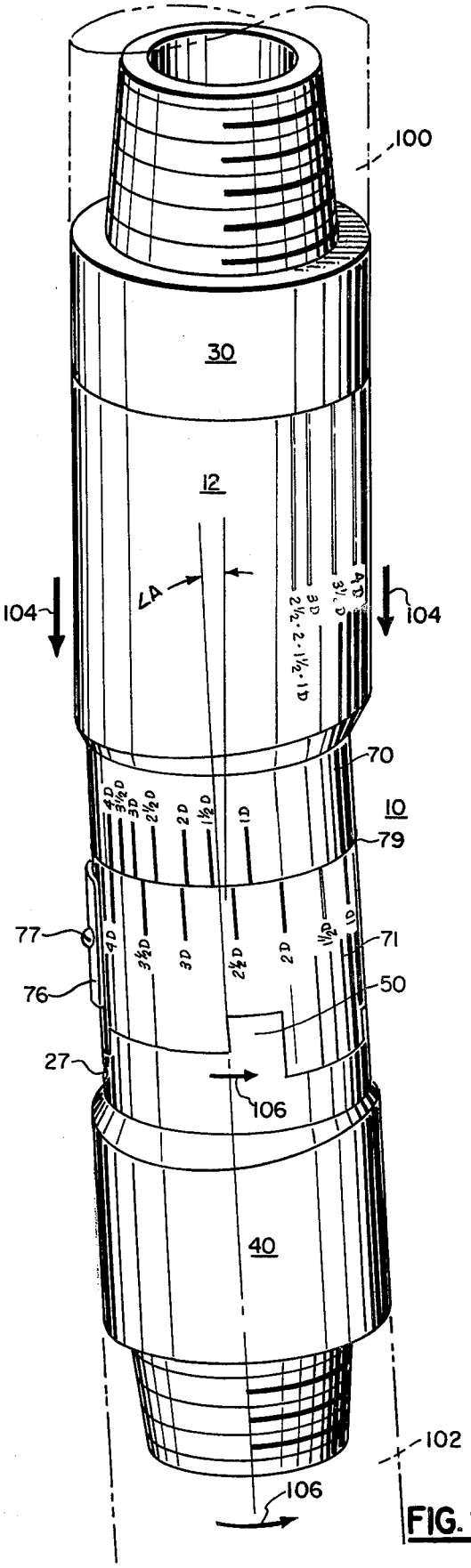
FIG. 2 is a side view of the first preferred embodiment of the apparatus of the present invention in its "bent" position as desired for directional drilling.
Figure 3:
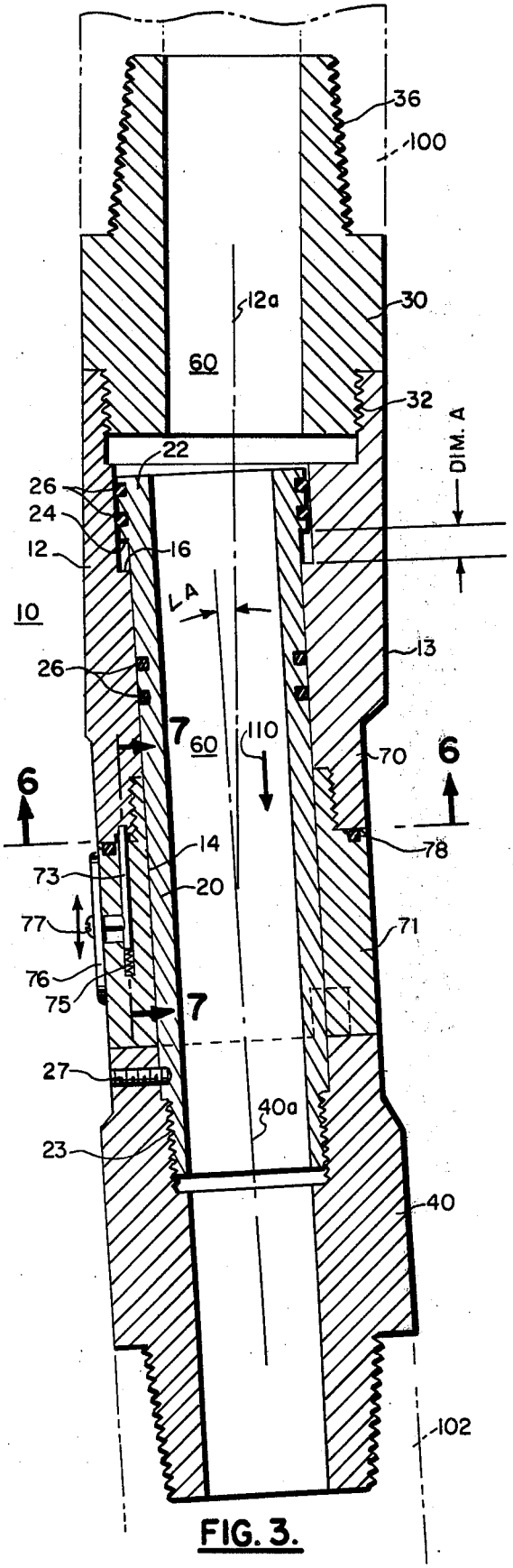
FIG. 3 is a cross-sectional, side view of the first embodiment in the "bent" disposition of FIG. 2.
Figure 4:
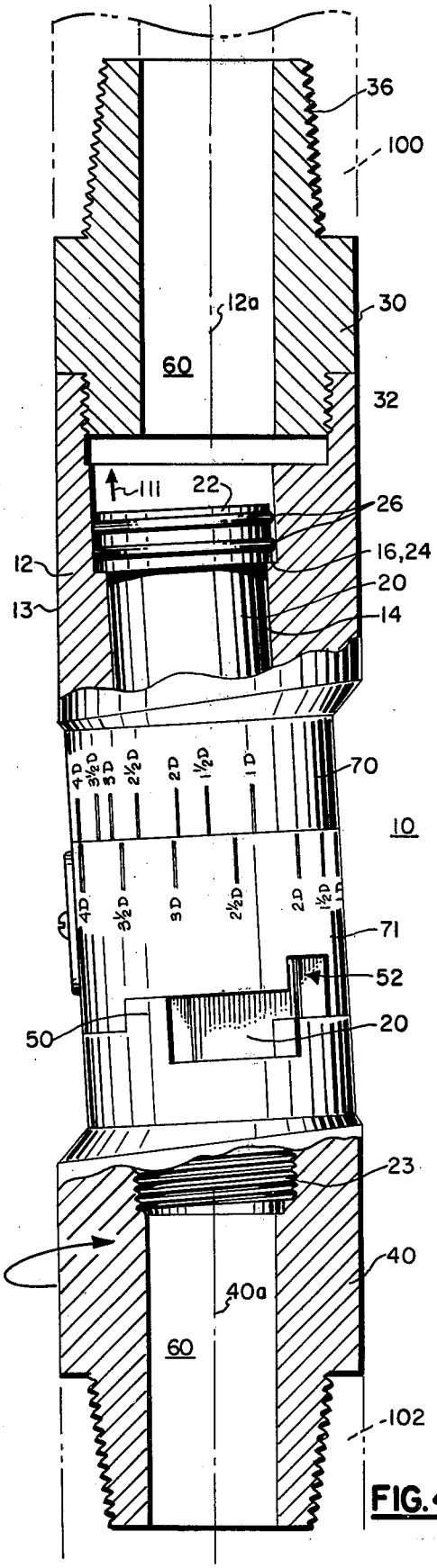
FIG. 4 is a side view, partially in cross-section, of the first embodiment in the aligned disposition of FIG. 1.

Aside from the rotation and its change in orientation of connection 40, a sliding movement is likewise seen in the apparatus 10 of the present invention, which sliding movement is relative between movable connection 40 and barrel 12. This sliding connection permits rotation to take place when movable connection 40 is at an extended position away from barrel 12 as is seen in FIGS. 1 and 4. When the movable connection 40 is moved to an extended position away from barrel 12 (and lugs 50 align with recesses 52), the device assumes a non-shifting, non-rotating, locked configuration as is seen in FIGS. 2 and 3. In this position, it can be seen that the device forms a "bent" orientation as is seen in conventional permanently bent deflecting subs which is their permanent structural configuration. Note in FIG. 4 that the central longitudinal axis 12*a* of barrel 12 and the central axis 40*a* of movable connection 40 are at least substantially aligned, while in FIG. 3 the axes (12*a*, 40*a*) of barrel 12 and movable connection 40 respectively are angled with respect to one another, the angle deflection being represented by the letter "A" in FIG. 3.

The orientation seen in FIGS. 1 and 4, which provides a substantially in-line orientation to sub 10, is used normally to lower or remove the drill string and the attached appropriate directional drilling tools into or from the hole. Uppermost fixed connection 30 will be connected to a non-magnetic survey collar 100 (frequently referred to as a "Monel Collar"). The lowermost or rotating end connection 40 is attached to for example a turbodrill 102, "Dyna-Drill" or the like (see this configuration as illustrated with a conventional permanently bent sub in FIG. 1 of the patent). Collar 100 and turbodrill 102 are partially shown in phantom lines in FIGS. 1–4.

FIG. 2 illustrates the orientation of sub 10 of the present invention, after the "Dyna-Drill" 102 has been actuated, which actuation produces a torsion in the drill string which causes the elements of sub 10 to shift, with movable connection 40 rotating with respect to barrel 12, and its rotation effecting the eccentricity in the drill string as aforementioned. When the "Dyna-Drill" is thereafter lowered and begins drilling, the movable connection 40 will "collapse", with lugs 50 of connection 40 interlocking with recesses 52 of barrel 12, to form a substantially tight, non-shifting, locked bent sub 10 (as has occurred in FIGS. 2 and 3). It should be understood that the torsion (illustrated by curved arrow 106 in FIGS. 1 and 2) produced in the drill string by the rotation of the turbodrill, "Dyna-Drill", or the like, will always urge the sub 10 into the "bent" configuration shown in FIGS. 2 and 3. Likewise, as long as axial force (note arrows 104 in FIG. 2) is present in the drill string (as is normally the case), the movable connection 40 will always be in a collapsed, mated position with respect to barrel 12, with lugs 50 locking into recesses 52 along with other corresponding mating sections provided along the opposing peripheries of connection 40 and barrel 12.

Figure 5:
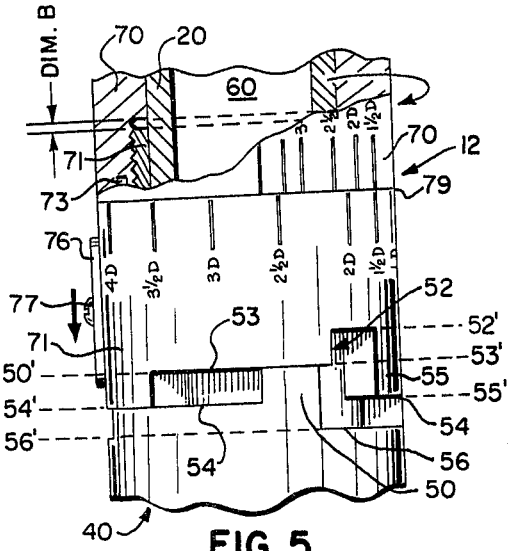
FIG. 5 is a partial side view of the first embodiment, showing particularly the lug/recess portion of the tool in an intermediate position of the movable elements between the extreme, aligned position of FIGS. 1 and 4 and the locked, "bent" position of FIGS. 2 and 3.
Figure 6:
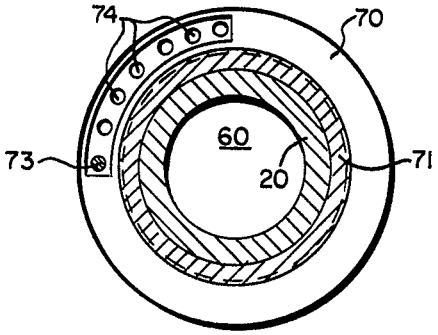
FIG. 6 is a lateral, cross-sectional view taken along section lines 6—6 of FIG. 3.

FIGS. 5 and 6 of the parent application/patent illustrate in greater details the locking lug arrangement of the first embodiment of the apparatus of the present invention, and reference is had to it for a further understanding of the details of this structure. While the first, intermediate and last positions of the sub 10 can be best seen in FIGS. 1, 5 and 2 hereof, respectively, as the device shifts from an in-line position to a bent position, the actual over-all lug and mating recess configuration can be better seen in FIGS. 5 and 6 of the parent case. An inspection of FIGS. 5 and 6 of the parent case will reveal that a plurality of like but reversed, opposed surfaces are provided on barrel 12 and on movable connector 40. An inspection will also reveal that the projections or lugs on connection 40 have corresponding recesses in barrel 12. As aforementioned, lugs 50 of movable connection 40 inter-relate with corresponding recesses 52 on barrel 12. It will be noted that both barrel 12 and movable end connection 40 are provided with sliding, flat, extended, mating surfaces which abut and frictionally slide against one another when the device is in an intermediate stage (note FIG. 5) when it is shifting from its aligned position to its "bent" position as shown in the figures.

As inspection of FIG. 5 hereof will reveal, the surfaces of lugs 55, the surface of sliding surface 53, and the upper, innermost portion of recess 52 of barrel 12 are all parallel and at three different elevations 55', 53' and 52', respectively, with respect to one another. Likewise, the lowermost surfaces of recess 56, the surface of sliding surface 54, and the uppermost portion of lugs 50 are all parallel and at three different respective elevations 56', 54' and 50', respectively, on movable connection 40. This is an important feature, because it provides an intermediate position as can best be seen in FIG. 5 where the device can freely rotate through only a certain arcuate distance in order to shift from an axially aligned to a "bent" position. As is best seen in FIG. 5, the surfaces of lugs 55 of barrel 12 slide upon and rest on the "intermediate" elevational surfaces of movable connection 40, those surfaces being sliding surfaces 54. This sliding can only occur through an arcuate distance of a desired degree (that degree of rotation being an element of design) since lugs 55 will abut against lugs 50 at each end of the arcuate path of rotation. In the preferred embodiment shown in FIGS. 2–6 of the parent case, as well as in the first preferred embodiment of the instant case, the sub 10 is designed to rotate through an angle of approximately sixty degrees (this being merely an exemplary arcuate travel distance).

When the sub rotates to its fully deflected position as shown in FIGS. 2 and 3, lugs 55 interlock into recesses 56, and lugs 50 of movable connection 40 interlock into recesses 52 of barrel 12.

As can best be seen in FIGS. 3 and 4, a central aperture 60 is provided through the centermost portion of sub 10, aperture 60 providing an opening through which drilling mud or like fluid can be pumped in order to operate the turbodrill, "Dyna-Drill", or like directional drilling apparatus 102.

Barrel 12 houses an inner sliding sleeve 20 which slidably fits within barrel 12 and slidably abuts the inner wall 14 thereof. The sliding mount through dimension "A" (FIG. 3) of sleeve 20 within barrel 12 is illustrated by directional arrows 110 and 111 in FIGS. 3 and 4 respectively.

As seen in FIG. 3, the upper, innermost end portion 22 of sleeve 20 provides an enlarged annular section 22 with a shoulder 24 being provided between the enlarged section 22 and the remaining portion of sleeve 20. A cooperating change in inner diameter is seen at this point in barrel 12 which provides a stop 16 for limiting the downward sliding movement of sleeve 20 within barrel 12. Normally, sleeve 20 could be removed from barrel 10 by sliding movement away from stop 16. However, in assembly, lower connection 40 is threadably affixed to sleeve 20, and thereafter prevents the removal of sleeve 20 from barrel 12. The sliding movement of sleeve 20 and its attached, rotating connection 40 is fixed in both directions. Sliding motion to an "extended" position (FIG. 4) is stopped when shoulder 24 hits stop 16. Sliding motion to an "innermost" or "recessed" position (FIG. 3) is stopped when movable connection 40 abuts barrel 12.

The assembly of sub 10 is completed when fixed end connection 30 is attached to the upper end portion of barrel 12 of the tool 10 opposite movable connection 40. In the preferred embodiment, as shown in FIGS. 3 and 4, this connection is a threaded connection 32.

Fixed end connection 30 is preferably of a substantially identical external diameter to that of barrel 12. The end portion of fixed connection 30 (which is free and normally connectable to the drill string or non-magnetic survey collar 100 as the case may be) is preferably provided with threads 36 which would be conventional and easily allow attachment to such conventional drill string or non-magnetic survey collar 100.

FIG. 3 illustrates best the sleeve 20 portion of the sub 10 of the present invention. Sleeve 20 can be provided with any conventional thread 23 for attachment to movable connection 40. The connection is set and held by means of a set screw 27 or can be made permanent by welding or the like after assembly if desired.

The opposite end portion of sleeve 20 from threads 23 provides an enlarged annular section 22 as aforementioned. Sleeve 20 is provided with a plurality of grooves in which sealing "O"-rings 26 are located. This prevents seepage or leaking of drilling mud from inner bore 60.

The preferred embodiment of sub 10 of the present invention, is shown in FIG. 3 in its shifted, "bent" condition. As can best be seen, this "bent" orientation is effected by a rotation of movable connection 40 with respect to barrel 12. The eccentricity is produced by the rotation, since the inner wall 14, and the center axis of rotation it defines, of barrel 12 is angled with respect to the outer surface 13 thereof. Likewise, movable connection 40 is threadably mounted on sleeve 20 with a like desired angular orientation between their central axes. With such a structure, the device rotates to a position which aligns the central axis 40*a* of movable connection 40 with the axis of fixed end connection 30 and the axis 12*a* of barrel 12, as is desirable while lowering or raising sub 10 and its attached turbodrill 102 and drill string 100 into or out of the hole. A rotation through the appropriate designed arcuate path produces an eccentricity between the axes 40*a* and 12*a* of movable connection 40 and barrel 12. The geometrical relationship underlying this operation of the tool are explained more fully below.

Figure 7:
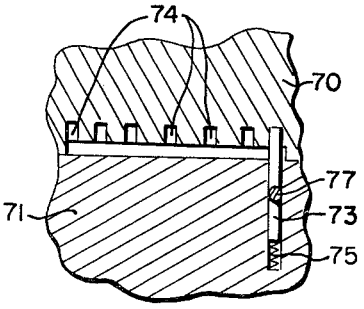

The preferred embodiments 10, 210 of the present invention, in contrast to that of the parent case, provide for a variety of different angles of deflection or deviation within the same tool. In the first embodiment 10 (FIGS. 1–7) this is achieved by making the barrel 12 into two rotatably adjustable sections 70, 71 which are adjusted and set with respect to one another on the surface by means of the male locking pin 73 which mates with the selected one of female openings 74. (See FIGS. 5–7). The locking pin 73 is biased upwardly into the mated one of the holes 74 by means of spring 75. An internal, close-up view of this mechanism is shown in FIGS. 6 and 7. The internal pin 73 is longitudinally movable from the outside of the tool 10 by means of the sliding bar 76 attached to the pin 73 by means of screw 77. An additional "O"-ring 78 is included for sealing the tool 10 between barrel sub-elements 70, 71. As illustrated, barrel sub-elements 70, 71 are each provided with a corresponding set of deviation angle markings (an exemplary series of half-angle steps from one degree to four degrees being illustrated in FIGS. 1 and 2) with the mating holes 74 in upper sub-element section 70 being spaced in correspondence with each of the angle markings illustrated.

On the surface, after the particular desired angle is selected (four degrees being selected for illustration purposes in FIGS. 1 and 2), bar 76 is moved downwardly so that pin 73 is disengaged from whatever hole 74 it happened to be engaged with. Upon disengagement of pin 73 from the hole 74, the barrel sub-elements 70, 71 are free to be rotatably movable with respect to each other on opposed, extended, flat mating surfaces between them, and they are so moved until the angle markings for the angle selected (for example four degrees as shown) line up with each other. The slidable bar 76 is then released, and the pin 73 under the action of compressed spring 75 is pushed into the "automatically" or inherently selected hole 74 which corresponds to the selected angle of deviation, thus again locking barrel sub-sections 70, 71 together for use. The tool 10 will then produce a "bent" sub with the particular angle of deviation selected. Thereafter, if desired, the angle of deviation of the tool 10 can be changed by again moving the bar 76 downwardly (note direction arrow in FIG. 5), rotating barrel sub-sections 70, 71 with respect to one another until the selected angle indicator markings on their exteriors line up, and then releasing bar 76 locking the sub sections 70, 71, together. The tool 10 will then be ready to produce the newly selected angle of deviation.

The change in degrees of the bent deflection is a matter of choice after one skilled in the art applies the teachings of the present invention. Thus, sub 10 could be easily machined to provide as illustrated a one degree (1°), one-and-one-half degree (1½°), two degrees (2°), two-and-one-half degrees (2½°), three degrees (3°), three-and-one-half degrees (3½°) and four degrees (4°), or like bent sub connections, these being typical sub degree deflections in the art. The selection of the angle of the sub is normally predetermined by the amount of angle and/or directional change required to maintain a proposed course for a given drilling situation. Normally a designer would take several factors into consideration in selecting the proper angle for sub 10. Some facts which would be considered would be:

1. hole size;
2. directional control required;
3. angle change per foot of hole drilled desired; and
4. the amount of drilling that can be accomplished with given bits for a given turbodrill.

OPERATION

The operation of the appratus 10 of the present invention can best be seen by an inspection of FIGS. 1–7.

In the method of the preferred embodiment of the present invention, the sub 10 is connected to the lowermost portion 100 of the drill string. An appropriate drilling means 102 such as a turbodrill, "Dyna-drill" or the like is attached to the sub 10 at movable connection 40. The axes of barrel 12 and movable connection 40 are then aligned axially so that the entire axially aligned drilling appratus can be lowered into the well hole. In FIG. 1, the device is shown in its axially aligned position. In this position, movable connection 40 is in an extended position, with sleeve 20 moving until shoulder 24 abuts and stops against stop 16. In this position, lugs 50 project down under the end surface 52 of barrel 12, thus clearing lugs 50 from rotation stops caused by the side walls of recess 52.

When the drill 102 reaches the desired position in the well hole and the turbodrill or like drilling means are positioned as desired, the drilling means is actuated to produce a torsion in the sub 10 to effect a shifting of the sub 10 to a second, axially deviated position. Such a deviated position in the sub 10 produces a corresponding deviating angle "A" (see FIG. 3) between the axes of the drill string and the drilling means. Thereafter, directional drilling can be commenced as is desirable. Of course it is desirable to know where or in what direction from the vertical the deviation is taking place, which will vary depending on how much angular rotation occurs from the zero, aligned position to the particular deviated, locked position set. To assist in this a further set of angular markings are located on the upper, main portion of the barrel 12 (see FIGS. 1 and 2) which indicate where along the lateral periphery of the upper connection 30 the indicated angular deviation will occur when it is selected on the lower set of matched, angular markings.

After drilling operations are completed, the drill string can be withdrawn from the well hole. Upon withdrawal, the sub 10 will extend with sleeve 20 sliding and movable head 22 extending to an extended most position whereby its ability to rotate with respect to barrel 12 is restored. Since the turbodrill or like drilling tool is no longer actuated, lateral torsion is absent from both the drill string and sub 10. Thus the urging force necessary to hold the sub 10 in a bent position is absent and the sub 10 (with connection 40 now free to rotate with respect to barrel 12) will gradually re-assume an aligned position as the drill string is withdrawn from the well hole. The axially aligned position is gradually reassumed since it provides the disposition with the path of least resistance, and no force is present to hold the sub 10 in the "bent" position.

The preferred embodiment as described herein as contemplated the use of a turbodrill, "Dyna-Drill" or like directional drilling tool which produces torsion in sub 10 upon its rotary actuation. It should be understood however that other drilling tools could be used in combination with the first preferred embodiment of the present invention if they create a torsion in the sub 10, which torsion produces a shift in sub 10 from an "axially aligned" position to a bent position. Likewise, the present invention could be adopted wherein the barrel and movable connection can be moved relative to each other for angular deviation by direct mechanical means or other means actuated for example from the surface or otherwise.

STRUCTURE OF SECOND EMBODIMENT

Figure 8:
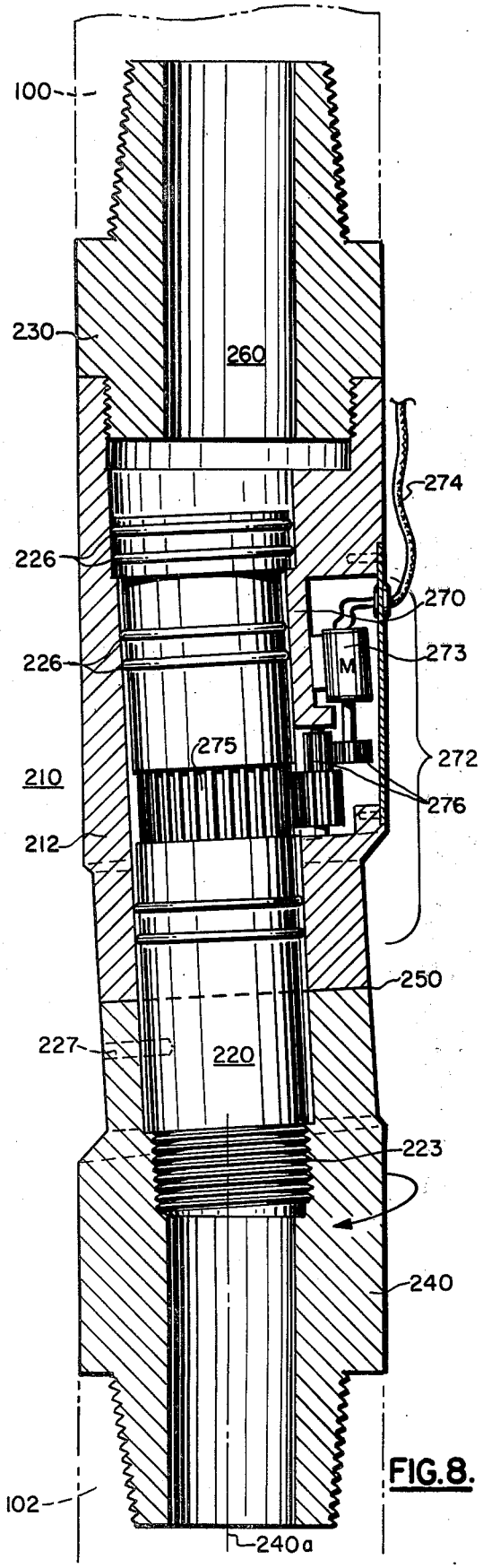
Figure 9:
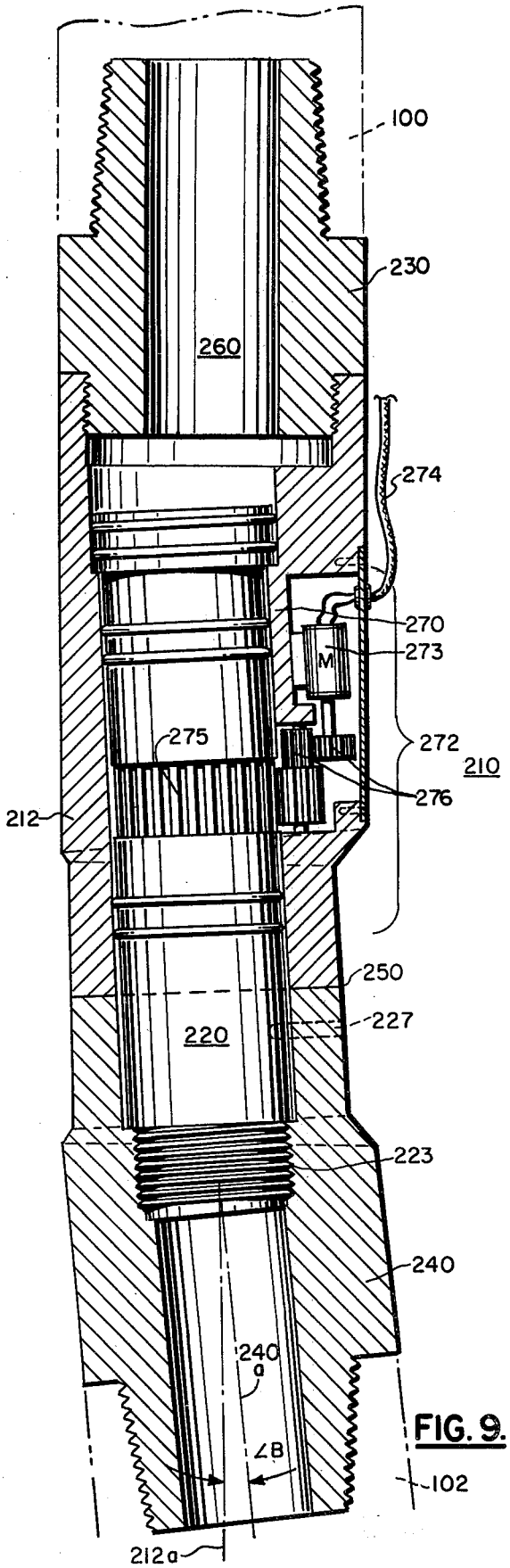

A second preferred embodiment 20 of the variable-angle sub of the present invention is illustrated in FIGS. 8 and 9 whose various elements, parts and operation are similar in many respects to that discussed in detail with respect to the first embodiment of FIGS. 1–7. Hence for the sake of brevity the similar or identical aspects will not be repeated here, and it is noted that the analogous elements and parts of the second embodiment have been similarly numbered as in the first embodiment with the addition of the pre-fixing of the numeral two. However, rather than having the manually set, variable system 72–77 of the first embodiment 10, this second embodiment 210 utilizes an internal motorized system 272 allowing variation from zero degrees to the maximum designed degree while the tool 210 is down in the hole.

The aligned disposition of the tool 210 is illustrated in FIG. 8, while the selected deviated or "bent" disposition is illustrated in FIG. 9.

The variable-angle motorized system 272 comprises an internal electric "slave" synchronized motor 273 operated through electrical "umbilical" control lines 274 going to a "master" synchro motor (not illustrated) on the surface. The internal motor 273 is attached to the upper, barrel section 270 and drives an associated drive system comprised of a set of gear teeth 275 fixed to the lower, barrel section 220 through an appropriate gearing system 276. Alternatively of course the internal motor 273 could be mounted on the lower, sleeve section 220 and rotatably drive the upper, barrel section 270.

By controlling the "master" synchro motor on the surface, the internal "slave" motor 273 is actuated until the desired angle of deviation is reached while the tool 210 is down "on the hole". When retrieval of the drill string, etc. is desired, the surface "master" synchro motor and accordingly the internal "slave" synchro motor 272 is backed off until the zero degree position is attained or, if desired, the rotation is continued on forward until a total rotation of three-hundred-and-sixty degrees had taken place, puting the tool 210 back in its zero or aligned disposition.

GEOMETRICAL RELATIONSHIPS

Figure 10:
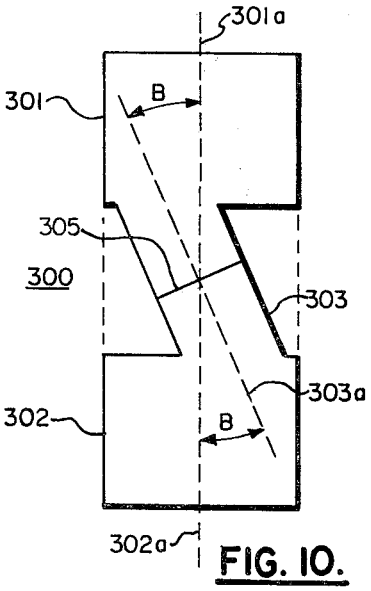
FIGS. 10 and 11 are schematic views illustrating the geometry involved in the structural operation of the preferred embodiments, with FIG. 10 representing the tool in its aligned disposition and FIG. 11 representing the tool in its "bent" disposition.
Figure 11:
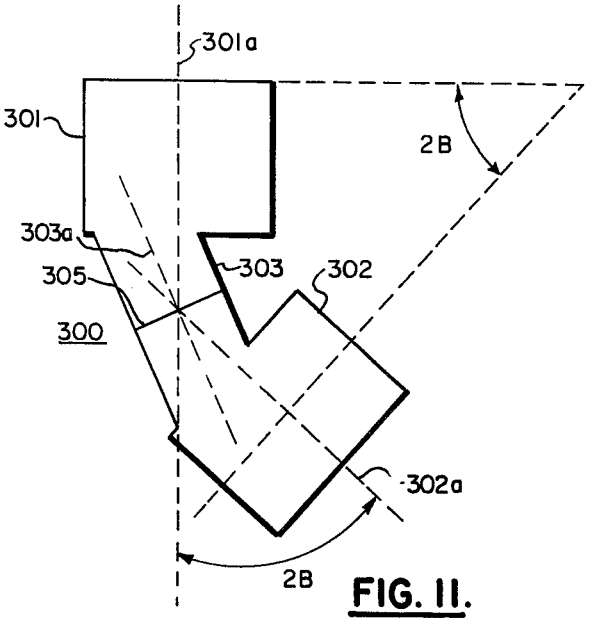

The geometrical relationships which underly the operation of the tool in allowing both an aligned non-deviated disposition and, when desired, a deviated or off-set disposition are schematically illustrated in FIGS. 10 and 11, respectively.

As illustrated, the tool 300 (analagous to 10, 210) includes three basic connection sections, a first, upper connection section 301 (analagous to 30 and 230) for connecting the tool to for example the drill string, a second, lower connection section 302 (analagous to 40 and 240) for connecting the tool to an operative device, for example a turbodrill with a drill bit, and a third, central connection section 303 (analagous to 12 and 212) for interconnecting the first two sections together, each of the three connection sections having a central longitudinal axis, 301*a*, 302*a* and 303*a*, respectively. Axis 303*a* also defines an axis of rotation offset from the other longitudinal axes 301*a*, 302*a* by some selected angle B of for example two degrees. The central connection section 303 allows said first two connection sections 301, 302 to be movably rotated with respect to one another about the axis of rotation 303*a*, with the rotational movement being guided by the extended flat mating surfaces 305 (analogous to 53/54 and 250) laterally movable in rotation with respect to one another, which surfaces lie in a plane perpendicular to the axis of rotation 303*a*.

As can be seen in FIG. 10, where the tool 300 is in its aligned position, the central longitudinal axes 301*a*, 302*a* of the upper and lower tool portions are coincident, each making an equal and offsetting angle "B" with the central axis of rotation 303*a* of the center portion. However, as the upper and lower sections 301, 302 are relatively rotated, the lower longitudinal axes 302*a* becomes deviated away from the upper longitudinal axis 301*a* with an ever increasing degree of angular deviation until a maximum deviation is reached with one-hundred-and-eighty degrees of rotation, at which time, as can be seen in FIG. 11, the maximum possible angle of deviation is reached at "2×B" or, in the example given at a total of four degrees. If the rotation was continued past one-hundred-and-eighty degrees or backed-off, that is reversed, the angle of deviation between the upper and lower sections 301, 302 would decrease until the starting or zero position had been reached, producing the aligned disposition of FIG. 10.

Of course, by starting with a greater angle of deviation "B" in excess of for example two degrees, such as for example three-and-a-half degrees, a desired four degree angle of deviation would be reached by relatively rotating the upper and lower sections 301, 302 with less than a hundred-and-eighty degree rotation. This situation is what is shown in the first embodiment 10 which only rotates approximately sixty-degrees to produce a four degree deviation. Likewise, by varying the limits on the maximum amount of rotation between the upper and lower sections 301, 302 about axis of rotation 303*a*, and by holding or locking the two sections 301, 302 together at that set limit during use of the operative device, the same tool 300 can be made variable and used for producing various ones of different selected deviation angles. This latter variability is achieved by the embodiments 10, 210 of the instant application. Thus for example in the first embodiment 10, by resetting the relative, laterally set positions between sub-sections 70, 71 by laterally moving the extended, mating surfaces 79 with respect to one another, each of which lie in a plane perpendicular to the central axis of rotation of sleeve 20, the maximum amount of rotation allowed after the aligned disposition is left before lug 50 hits the stopping wall of recess 52 is changed, with the lesser amount of rotation allowed before locking or stopping producing the smaller amount of angular deviation. Alternatively, of course, the lugs 50 could themselves be made movable to change the point of rotation stop or a variable stop system for selectively limiting the amount of rotation of sleeve 20 within barrel 12 could be provided. Or, as a further possible arrangement, the internal structure of the tool 10 could be redesigned to allow variation in the angle the offset axis of rotation 303*a* makes with the other longitudinal axes 301*a*, 302*a*.

In the embodiment 210, the amount of deviation is adjusted by means of activating the motor and merely holding it at the particular selected point of rotation producing the desired degree of deviation.

It is also noted that both the lateral mating surfaces 305 (53/54 and 250) and the nested, mating, cylindrical surfaces between the barrel 12, 212 and the sleeve 20, 220 of the tool, 10, 210, conjunctively perform the same job of guiding the relative rotation between the analogous upper and lower sections 301, 302 of the tools. Hence, although having both is desirable from a strength standpoint, it would be possible to redesign the tool to eliminate or alter one or the other of the mating surface guidance systems.

Also, it is noted that it is desirable that the exterior surfaces of the upper and lower sections 301, 302 form cylindrical surfaces of the same diameter and that the maximum diameters of the guiding mating surfaces, including the planar surfaces as well as the cylindrical surfaces, measured from the axis of rotation 303*a* are smaller for compactness of the tool.

It should be understood that, in using the terms "sub" or "tool" herein, such term includes the situation where the invention hereof is used in a separate tool as illustrated or is part of or a sub-element of another device or tool such as for example being made a part of the turbodrill or "Monel Collar" itself.

As a further example of a possible variation, a "hybrid" tool using portions of the embodiments 10, 210 could be designed, using the basic design of tool 10, but with a surface-controlled, internal motor (like that in embodiment 210) to vary the relative positions of variable angle sub-sections 70, 71 while "down in the hole." Such a version would have the motor and its associated drive working between the sub-sections 70, 71 and would not have the heavy load on the motor drive system as the embodiment 210 does in working between the barrel section 212 and the sleeve 220.

Of course, for greater deviations than that achieved by one tool, a "piggy-back" combination of two or more of such tools in line could be used to produce a combined total angle of deviation of the sum of each of the tools.

Because may varying and different embodiments may be made within the scope of the inventive concept herein taught, and because many modifications may be made in the embodiments herein detailed in accordance with the descriptive requirements of the law, it is to be understood and not in a limiting sense.

What is claimed as invention is:

1. A directional tool for causing the direction of an operative device such as, for example, a drill bit to be offset and deviated down in the hole from the straight-angle of the drill string nearest it comprising:

a. an extended tool body;

b. first connection means on an upper end of said tool body for attaching said tool body to the drill string and having a central longitudinal axis hereafter referring to as the top longitudinal axis;

c. second connection means on the lower end of said tool body for attaching the operative device to said tool body and having a central longitudinal axis hereinafter referred to as the bottom longitudinal axis;

d. central connection means between said first and second connection means for connecting said first and second connection means together and allowing them to rotate relative to one another, the said relative rotation making an angle with both said top and said bottom longitudinal axes, said second connection means and said first connection means being rotatably movable through said central connection means from a first position, in which said top and bottom longitudinal axes are at least substantially parallel, allowing the tool to be moved through the hole with the drill string and the operative device in alignment at least part of the time, to a second position down in the hole in which said top and bottom longitudinal axes are deviated making an angle with one another, causing the direction of the operative device to be offset and deviated down in the hole from the straight angle of the new drill string nearest it of rotation being fixed as said first and said second connection means are rotatably moved between said first and said second positions, and said central connection means has at least two, extended planar mating in face-to-face relationship surfaces lying at least in part in a plane perpendicular to said axis of rotation and laterally movable with respect to one another and disposed in at least some spaced portions about said axis of rotation, and said central connection means has associated with it a central cylindrical surface about its axis of rotation and wherein at least one of said first and second connection means has associated with it an interior cylindrical surface having a central longitudinal axis coincident with said axis of rotation and a diameter nearly equal to the diameter of said central cylindrical surface, said cylindrical surfaces being nested and mating with one another in face-to-face relationship for relative rotation, and said cylindrical surfaces and said planar mating surfaces guiding and positioning said first and said second connection means as they rotate with respect to one another between said first and said second positions.

2. A directional tool for causing the direction of an operative device such as, for example, a drill bit to be off-set and deviated down in the hole from the straight-angle of the drill string nearest it comprising:

a. an extended tool body;

b. first connection means on an upper end of said tool body for attaching said tool body to the drill string and having a central longitudinal axis hereafter referred to as the top longitudinal axis;

c. second connection means on the lower end of said tool body for attaching the operative device to said tool body and having a central longitudinal axis hereinafter referred to as the bottom longitudinal axis;

d. central connection means between said first and second connection means for connecting said first and second connection means together but allowing them to rotate with respect to one another about an axis of rotation different from and making an angle with both said top and said bottom longitudinal axes, and said central connection means has at least two, extended flat mating surfaces lying in a plane perpendicular to said axis of rotation and laterally movable with respect to one another and disposed in at least some spaced portions about said axis of rotation, said second connection means and said first connection means being rotatably movable through said central connection means about said axis of rotation from a first position, in which said top and bottom longitudinal axes are at least substantially parallel, allowing the tool to be moved through the hole with the drill string and the operative device in alignment at least part of the time, to a second position down in the hole in which said top and bottom longitudinal axes are deviated making an angle with one another, causing the direction of the operative means to be off-set and deviated down in the hole from the straight-angle of the drill string nearest it, said axis of rotation being fixed as said first and said second connection means are rotatably moved between said first and said second positions; and e. locking means for at least temporarily locking said first and said connection means together in said second position, allowing said operative device to be maintained in its deviated disposition during its use down in the hole.

3. The tool of claim 2 wherein said central connection means has at least one stop limiting the amount of rotation of said first and said second connection means to a degree within a range of zero to one-hundred-and eighty degrees.

4. A directional tool for causing the direction of an operative device such as, for example, a drill bit to be off-set and deviated down in the hole from the straight-angle of the drill string nearest it comprising:

a. an extended tool body;

b. first connection means on an upper end of said tool body for attaching said tool body to the drill string and having a central longitudinal axis hereafter referred to as the top longitudinal axis;

c. second connection means on the lower end of said tool body for attaching the operative device to said tool body and having a central longitudinal axis hereinafter referred to as the bottom longitudinal axis;

d. central connection means between said first and second connection means for connecting said first and second connection means together but allowing them to rotate with respect to one another about an axis of rotation different from and making an angle with both said top and said bottom longitudinal axes, said second connection means and said first connection means being rotatably movable through said central connection means about said axis of rotation from a first position, in which said top and bottom longitudinal axes are at least substantially parallel, allowing the tool to be moved through the hole with the drill string and the operative device in alignment at least part of the time, to a second position down in the hole in which said top and bottom longitudinal axes are deviated making an angle with one another, causing the direction of the operative means to be off-set and deviated down in the hole from the straight-angle of the drill string nearest it, said axis of rotation being fixed as said first and said second connection means are rotatably moved between said first and said second positions; and e. variable angle adjustment means for allowing within the same tool body the precise selection of different angles of deviation produced by said central connection means when said first and said second connection means are in said second position.

5. The tool of claim 4 wherein variable angle adjustment means comprises a motor and an associated drive system mounted between said central connection means and at least one of said first and said second connection means, said motor being fixed on one of said connection means and said associated drive system being connected to the other of said connection means, the actuating of the motor driving said associated drive system causing relative rotation between said first and said second connection means about said axis of rotation.

6. The tool of claim 5 wherein there is further included control line means for controlling the actuation and movement of said motor while in the hole, said control line means and said motor being operably connected together.

7. The tool of claim 6 wherein said motor is a synchro "slave" motor.

8. The tool of claim 4 wherein said variable angle adjustment means includes variable means on at least one of said connection means for varying the maximum amount of rotation allowed between said first and said second connection means in moving to said second position.

9. The tool of claim 8 wherein said variable means includes at least two, extended flat mating surfaces with associated locking means, said two surfaces being temporarily laterally movable for relative adjustment of the allowed maximum rotation but otherwise being locked together without allowing lateral relative movement during use.

10. The tool of claim 9 wherein there is included on both sides of said mating surfaces opposed sets of deviation degree indicator marks whose positions are determined by the amount of maximum rotation allowed for the desired degree of deviation when the indicator marks for the degree are matched across said surfaces.

11. The tool of claim 9 wherein there is further included a set of like indicator marks on the exterior of said tool body indicated where along the periphery of said tool body the desired deviation is produced.

* * * * *